United States Patent [19]

Asselman et al.

[11] 4,375,832

[45] Mar. 8, 1983

[54] TUBE AND FIN RADIATOR

[75] Inventors: George A. Asselman; Adrianus P. J. Castelijns; Adrianus J. Van Mensvoort, all of Eindhoven, Netherlands

[73] Assignee: U.S. Philips Corporation, New York, N.Y.

[21] Appl. No.: 136,236

[22] Filed: Apr. 1, 1980

Related U.S. Application Data

[63] Continuation of Ser. No. 930,150, Aug. 2, 1978, abandoned, which is a continuation of Ser. No. 732,368, Oct. 14, 1976, abandoned.

[30] Foreign Application Priority Data

Oct. 29, 1975 [NL] Netherlands ..... 7512632

[51] Int. Cl.[3] ..... F28D 1/00

[52] U.S. Cl. ..... 165/152; 29/157.3 R

[58] Field of Search ..... 29/157.3 R; 165/151, 165/152, 153

[56] References Cited

U.S. PATENT DOCUMENTS

| | | | |
|---|---|---|---|
| 1,553,093 | 8/1925 | Modine | 165/151 |
| 2,329,789 | 9/1943 | Schank et al. | 29/157.3 R |
| 2,592,950 | 4/1952 | Przyborowski | 165/153 |
| 3,263,313 | 8/1966 | Modine | 29/157.3 A |
| 3,521,707 | 7/1970 | Brown | 165/152 |

*Primary Examiner*—William R. Cline
*Assistant Examiner*—Theophil W. Streule, Jr.
*Attorney, Agent, or Firm*—David R. Treacy

[57] ABSTRACT

A radiator comprising a number of parallel cooling medium pipes having fin stacks secured thereto in which a metal strip of the desired width dimensions is zigzag folded to form a stack having successive fin parts and side parts, each fin part being divided into stepwise parallel portions by additional fold areas parallel to the side parts.

1 Claim, 2 Drawing Figures

TUBE AND FIN RADIATOR

This is a continuation of application Ser. No. 930,150, filed Aug. 2, 1978, now abandoned, which in turn is a continuation of application Ser. No. 732,368, filed Oct. 14, 1976, now abandoned.

The invention relates to a radiator comprising a number of parallel cooling medium pipes with fin stacks connected thereto, in which a metal strip of the desired width dimension is folded in a zig-zag manner to form a stack so that a number of zig-zag fin parts extending between the sidewalls of the stack are formed between which side strip parts of mutual equal length and shape are situated, after which the resulting stack is compressed so that the side parts engage each other on both sides of the stack and one or both sides is or are secured to a cooling medium pipe.

In the manufacture of radiators it is desired that all the fins be situated at mutually equal distances from each other because in this manner a regular matrix structure and hence an optimum effect is obtained. This has proved difficult to realize for fins of large length.

Dutch Patent Application No. 7,214.059 to which U.S. Pat. No. 3,874,053 corresponds, discloses a method in which, as described above, a metal strip is folded along its width dimension in a zig-zag manner and is then compressed. This is a very easy method for radiators having a small distance between the cooling medium pipes and provides a good, regular and finely divided matrix. A drawback is that upon soldering the stacks thus formed, a fairly large amount of tin draws between the fin parts. In the case of larger distances between the coolig pipes it is difficult to obtain and maintain a regular structure in this manner.

The radiator is made by a method which produces a very regular and stable structure when larger distances exist between the cooling medium pipes.

The radiator is characterized in that upon folding the strip about folding axes parallel to its width dimension in a zig-zag manner to form alternating fin and side parts, the fin first parts are bent about axes parallel to the folding axes (along the strip width dimension); at mutually equal distances in such manner that successive portions of the fin part extend in mutually parallel planes stepwise after each other.

Figure 1:
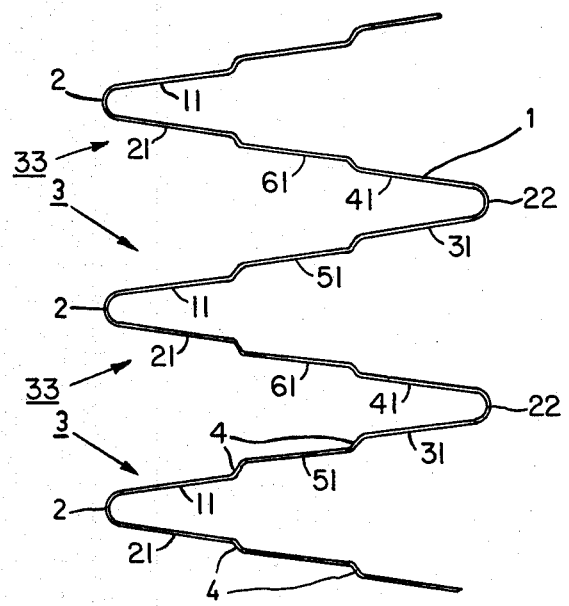
Figure 2:
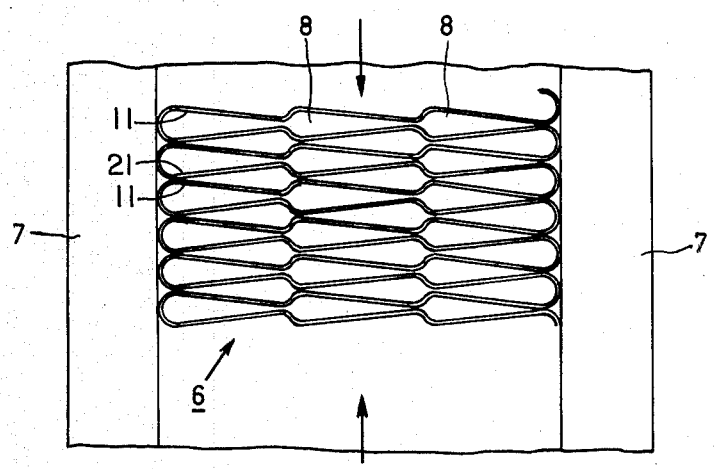

The invention will be described in greater detail with reference to the drawing in which FIG. 1 shows a folded strip which is not yet compressed and FIG. 2 shows a part of a radiator having a strip as shown in FIG. 1 in the compressed condition.

Reference numeral 1 in FIG. 1 denotes a metal strip which has been folded about folding axes parallel to its width dimension in a zig-zag shape with means suitable for that purpose. The folding operation results in the formation of alternating fin and side parts; side part 2, fin part 3, side part 22, fin part 33, side part 2, and son on. At regularly spaced bend areas 4 said fin parts 3 33 are provided with regularly spaced folds or bends about axes parallel to the folding axes in such manner that each of the fin parts 3 is subdivided into planar portions 11, 31 and 51 which extend in parallel planes stepwise after each other and each of the fin parts 33 is subdivided into planar portions 21, 41 and 61 which extend in parallel planes stepwise after each other. The planar portions 11 and 21 form respective first and second sets extending from the side parts 2 to bend areas 4 bounding or defining the planar portions. The planar portions 31 and 41 form respective third and fourth sets extending from bend areas defining the respective portions to the side parts 22, the third set of portions 31 being parallel to the first set of portions 11, and the fourth set of portions 41 being parallel to the second set of portions 21. Between the bend areas of each fin part 3 a third planar portion 51 is parallel to the portions 11 and 31, and between the bend areas of each fin part 33 a third planar portion 61 is parallel to the planar portions 21 and 41.

After folding the strip to form the shape as shown in FIG. 1, the strip is compressed to form a matrix 6 as is shown in FIG. 2. Therefore the curved bands of the side parts 2 and 22 provide a narrow engagement area between consecutive side parts, as shown; and the planar portions, e.g. 11 and 21, are spaced from each other at locations adjoining the side part 2, and converge toward and contact each other at the bend area defining these portions. The side parts 2 of the matrix 6 are then soldered to cooling medium pipes 7. The shape of the air duct 8 in the matrix 6 is now determined by the dimension and the mutual distance between the side parts 2 and the fold areas 4. It will be obvious that the matrix 6 obtained is very robust and will not readily deform. The distance between the cooling medium pipes can now be chosen at will without thereby influencing the rigidity of the matrix.

The contacting strip parts enclose rather large angles in the contact places so that little solder will land between the strips.

What is claimed is:

1. A radiator having a plurality of parallel cooling medium pipes having fin stacks secured thereto, wherein a fin stack comprises a zigzag folded metal strip of a desired width dimension forming alternating fin and side parts, said side parts being formed by fold areas equally spaced and defining equal length fin parts therebetween, all respective successive side parts at each respective side of the stack engaging each other, at least one stack side being secured to a cooling medium pipe;

said fin parts being divided by a succession of regularly spaced bend areas into planar portions, all said bend areas extending in a direction parallel to said fold areas, said planar portions extending, from the successive side parts defining said fin parts, in mutually parallel stepwise planes, arranged such that the first planar portions which extend from a side part at one side converge toward the engage each other at a bend area.

* * * * *

UNITED STATES PATENT AND TRADEMARK OFFICE

CERTIFICATE OF CORRECTION

PATENT NO. : 4,375,832

DATED : March 8, 1983

INVENTOR(S) : GEORGE ASSELMAN ET AL

It is certified that error appears in the above—identified patent and that said Letters Patent is hereby corrected as shown below:

Col. 2, line 57

Change "toward the" to --toward and--

Signed and Sealed this

*Third* Day of *May 1983*

[SEAL]

*Attest:*

GERALD J. MOSSINGHOFF

*Attesting Officer*

*Commissioner of Patents and Trademarks*